US007721791B2

(12) United States Patent
Hayasaka et al.

(10) Patent No.: US 7,721,791 B2
(45) Date of Patent: May 25, 2010

(54) HEAT EXCHANGER WITH SIDE PLATE HAVING PIPE NEAR BRIDGE PORTION

(75) Inventors: Atsushi Hayasaka, Kariya (JP); Ryouichi Sanada, Obu (JP)

(73) Assignee: Denso Corporation, Kariya (JP)

( * ) Notice: Subject to any disclaimer, the term of this patent is extended or adjusted under 35 U.S.C. 154(b) by 219 days.

(21) Appl. No.: 11/825,839

(22) Filed: Jul. 9, 2007

(65) Prior Publication Data

US 2008/0006392 A1 Jan. 10, 2008

(30) Foreign Application Priority Data

Jul. 10, 2006 (JP) ..... 2006-189821

(51) Int. Cl.
*F28F 7/00* (2006.01)
*F28D 1/00* (2006.01)

(52) U.S. Cl. ..... 165/81; 165/149; 165/916

(58) Field of Classification Search ..... 165/81, 165/149, 916

See application file for complete search history.

(56) References Cited

U.S. PATENT DOCUMENTS 6,328,098 B1 * 12/2001 Kodumudi et al. ..... 165/149
6,736,193 B2 * 5/2004 Kodumudi et al. ..... 165/81
7,198,095 B2 * 4/2007 Nguyen ..... 165/81
7,389,810 B2 * 6/2008 Harada ..... 165/149
2002/0023734 A1 * 2/2002 Wagner ..... 165/81
2006/0185824 A1 * 8/2006 Harada ..... 165/81
2008/0047689 A1 * 2/2008 Hirose et al. ..... 165/81

FOREIGN PATENT DOCUMENTS

EP 1 001 241 5/2000
JP 2005-156068 6/2005

* cited by examiner

*Primary Examiner*—Cheryl J Tyler
*Assistant Examiner*—Brandon M Rosati
(74) *Attorney, Agent, or Firm*—Harness, Dickey & Pierce, PLC

(57) ABSTRACT

A heat exchanger that can prevent damage to joints of tubes and side plates at core plates and is easy to produce which has side plates enabling stable brazing of the tubes and fins with the side plates, that is, a heat exchanger provided with a plurality of tubes through a heat exchange medium passes, a plurality of fins alternately stacked with the tubes and increasing the heat transfer of the heat exchange medium, core plates to which the two ends of the tubes are connected, and side plates arranged at the outsides in the stacking direction from the end fins arranged at the outermost sides in the stacking direction of the fins and connected to the core plates, wherein at least one of the side plates has a plurality of bridge portions at intermediate locations in the longitudinal direction, and at least one location of the bridge portions has a slit provided by cutting after the brazing of the tubes and the fins.

3 Claims, 6 Drawing Sheets

FIG. 7

| NO. | TYPE | DEFLECTION $\delta$ (mm) | FORCE REQUIRED FOR 0.2mm DISPLACEMENT F (N) | |
|---|---|---|---|---|
| | | NO CUTTING OF PART C | NO CUTTING OF PART C | WITH CUTTING OF PART C (TWO SIDES) |
| 1 | WITH BRIDGE PORTIONS a=8mm, b=2mm, c=2mm, h=14.6mm, $\theta$=45° | 0.162 | 1946 | 870 |
| 2 | WITH BRIDGE PORTIONS a=8mm, b=2mm, c=2mm, h=14.6mm, $\theta$=0° | 0.149 | 2690 | 1468 |
| 3 | WITHOUT BRIDGE PORTIONS (CONVENTIONAL TYPE) h=14.6mm | 0.129 | 4127 | — |

HEAT EXCHANGER WITH SIDE PLATE HAVING PIPE NEAR BRIDGE PORTION

BACKGROUND OF THE INVENTION

1. Field of the Invention

The present invention relates to a heat exchanger and is effective for use for radiator which cools coolant water of a vehicle engine, an oil cooler of a vehicle transmission, and a heat exchanger in which a plurality of heat exchange media pass through separate paths.

2. Description of the Related Art

In the past, there has been known a core structure of a heat exchanger comprised of a plurality of tubes 2 through the inside of which an internal heat exchange medium passes, a plurality of fins 3 alternately stacked with the tubes and increasing the heat transfer of said heat exchange medium, core plates 5*a* to which the two ends of the tubes are connected, and side plates 7 arranged at the outsides in the stacking direction from the end fins 3*a* arranged at the outermost sides in the stacking direction of the fins and connected to the core plates 5*a* (see FIG. 1).

In this types of core structure of a heat exchanger, the tubes 2 and the corrugated fins 3 are alternately arranged between the two core plates 5*a* arranged facing each other across a predetermined distance. The two ends of the two core plates 5*a* are bridged by the side plates 7. Further, the two ends of the tubes 2 and the side plates 7 are inserted into the tube holes and the side plate holes provided at the core plates 5*a* and the insertion parts are brazed there (see FIG. 2).

However, in the aforementioned heat exchanger, when the heat exchange medium begins to pass through the tubes 2, the difference between the amount of heat expansion of the tubes 2 and the core plates 5*a* which directly receive the effect of the heat exchange medium and the amount of heat expansion of the side plates 7 which do not directly receive the effect of the heat exchange medium causes thermal stress accompanied with thermal strain in the tubes 2 and the side plates 7. Further, if thermal stress is repeatedly generated, there is the problem of fatigue breakage in the vicinities 7*z* of the joints (insertion part) of the tubes 2 and the side plates 7 in the core plates 5*a*.

As a countermeasure, there is the art described in European Patent Publication No. 1001241.This bends parts of the side plates to enable the side plates to easily expand and contract in their longitudinal directions and absorb the amounts of heat expansion of the tubes and the side plates and thereby prevent in advance the parts where the tubes and the side plates are joined from fatigue breakage. Further, in the art described in Japanese Patent Publication (A) No. 2005-156068, the side plates are provided with zigzag slits to enable easily expansion and contraction perpendicular to the longitudinal direction. However, in these arts, the structures of the side plates are complicated, so production is not simple and the cost becomes high.

Further, when brazing the tubes and fins with the side plates, for example, wires or other jigs are used to arrange the side plates at the two outer sides of the tube and the fin assembly and these are brazed while simultaneously pressing these by a plurality of wires. (The set positions of the wires shown by the imaginary lines J in FIG. 2.) During this pressing operation, when using the side plates of the arts described in European Patent Publication No. 1001241 and Japanese Patent Publication (A) No. 2005-156068, since the side plates are low in rigidity, the tubes and fins cannot be uniformly pressed with the side plates and stable brazing is not possible.

SUMMARY OF THE INVENTION

An object of the present invention is to provide a heat exchanger able to prevent breakage at the joints of the tubes and the side plates at the core plates, able to be easily produced, and reduced in cost which has side plates enabling stable brazing of the tubes and the fins with the side plates.

According to a first aspect of the present invention, there is provided a heat exchanger wherein at least one of the side plates 7 has a plurality of bridge portions 7*c* and 7*d* at intermediate locations in the longitudinal direction and wherein at least one location 7*d* of the bridge portions has a slit 7*e* provided by cutting after brazing of the tubes 2 and the fins 3.

Due to this, when brazing the tubes and the fins with the side plates, the rigidity of the side plates is maintained (flexing is difficult) and the tubes and the fins can be uniformly pressed with the side plates. Because of this, stable brazing of the tubes and the fins with the side plates becomes possible. Further, after brazing, at least one location of the bridge portions is cut. Due to this, even if the side plates thermally expand during use of the heat exchanger, since the rigidity is low, simple expansion and contraction become possible in the longitudinal direction and thermal stress can be reduced.

According to a second aspect of the present invention, there is provided a heat exchanger wherein the slit 7*e* is provided at the periphery of the side plate 7 assembled in said heat exchanger. Because of this, cutting becomes easy.

According to a third aspect of the present invention, there is provided a heat exchanger wherein at least one location 7*c* of a bridge portion which is not cut is bridged at an angle with respect to a longitudinal direction of said side plate 7. Because of this, at the time of brazing the tubes and fins with the side plates, the rigidity of the side plates is secured and, at the time of thermal expansion, the rigidity is lower, so expansion and contraction become possible by the longitudinal direction, and the thermal stress can be reduced more.

According to a fourth aspect of the present invention, there is provided a heat exchanger according to claim 1, wherein said side plates 7 have substantially U-shaped cross-sections, pipes 6 are arranged extending inside said cross-sections, and the pipes stick out from the insides of the cross-sections near said bridge portions 7*c*, 7*d*. Because of this, the space near the cut location is secured and cutting becomes easy.

According to a fifth aspect of the present invention, there is provided a heat exchanger wherein a plurality of separate paths are formed inside and a plurality of heat exchange media pass through the separate paths. Because of this, a heat exchanger for a plurality of heat exchange media can be made more compact.

According to a sixth aspect of the present invention, there is provided a heat exchanger wherein one of the plurality of said heat exchange media is a high temperature medium and the other is a low temperature medium, said side plates are comprised of one 7 arranged at the side near the tubes through which said high temperature medium passes and one 71 arranged at the side near the tubes through which said low temperature medium passes, said side plate 7 arranged at the side near the tubes through which said high temperature medium passes has a bridge portion 7*d* having said slit 7*e*, and said side plate 71 arranged at the side near the tubes through which said low temperature medium passes has no bridge portions 7*c*, 7*d* at all. Since it is not necessary to provide the bridge portions at the side plate resistant to the effects of heat expansion, it is possible to eliminate unnecessary processes.

According to a seventh configuration of the present invention, there is provide a method of producing a heat exchanger comprising cutting at least one location 7*d* of the bridge portions 7*c* and 7*d* after brazing the tubes 2 and the fins 3.

Note that the reference numerals of the above parts show the correspondence with specific parts described in the embodiments explained later.

BRIEF DESCRIPTION OF THE DRAWINGS

These and other objects and features of the present invention will become clearer from the following description of the preferred embodiments given with reference to the attached drawings, wherein:

FIGS. 6A to 6C are views showing the calculation conditions of simulation calculations, wherein FIG. 6A is a three-sided view of a side plate being calculated, FIG. 6B is a view showing the calculation conditions for calculating deflection, and FIG. 6C is a view showing the force when forcibly displacing a side plate;

FIG. 7 is a view of the results of different types of simulation calculations under the calculation conditions of FIG. 6.

DESCRIPTION OF THE PREFERRED EMBODIMENTS

First Embodiment

Figure 1:
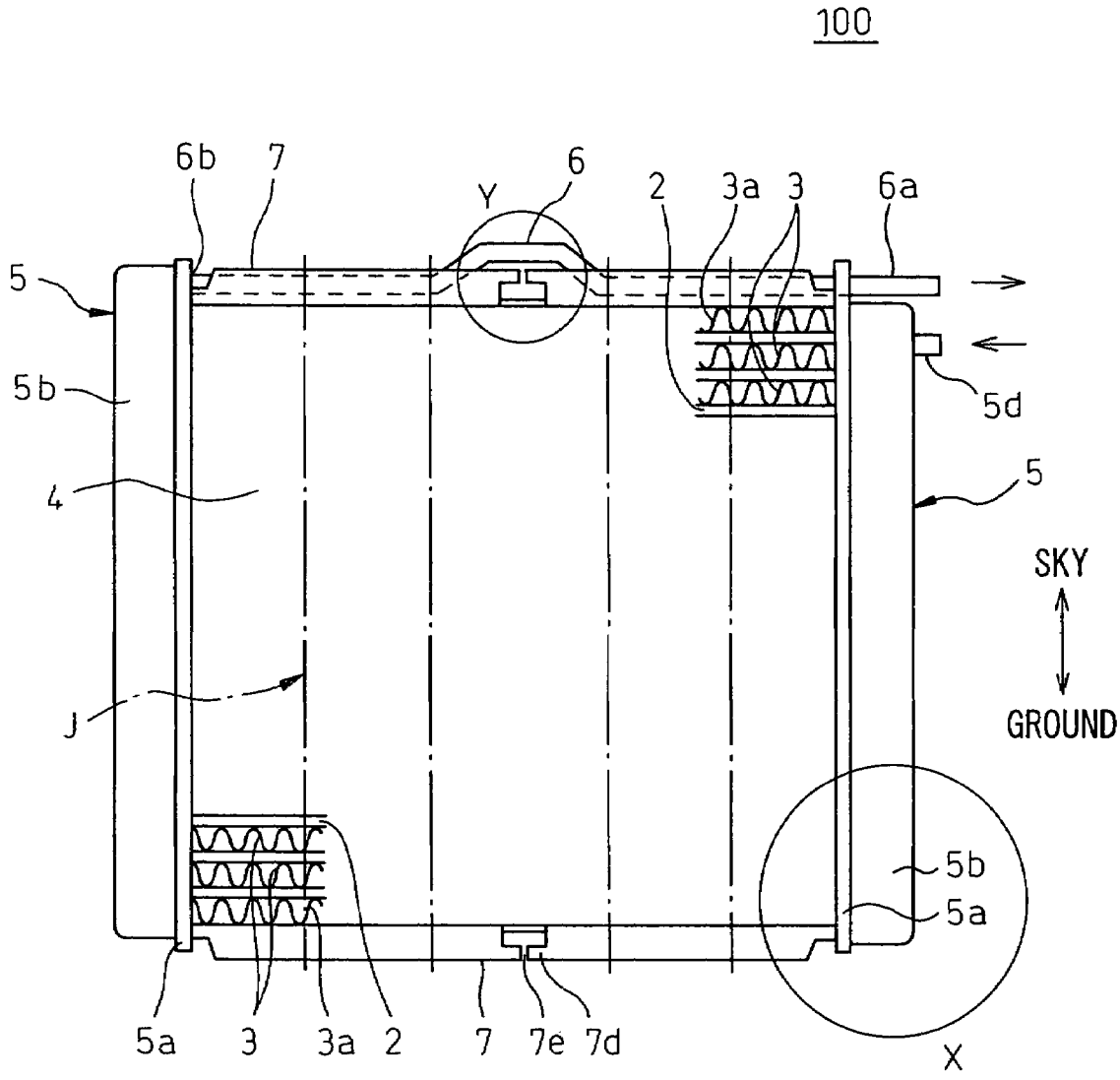
FIG. 1 is an overview of a heat exchanger according to a first embodiment of the present invention.
Figure 2:
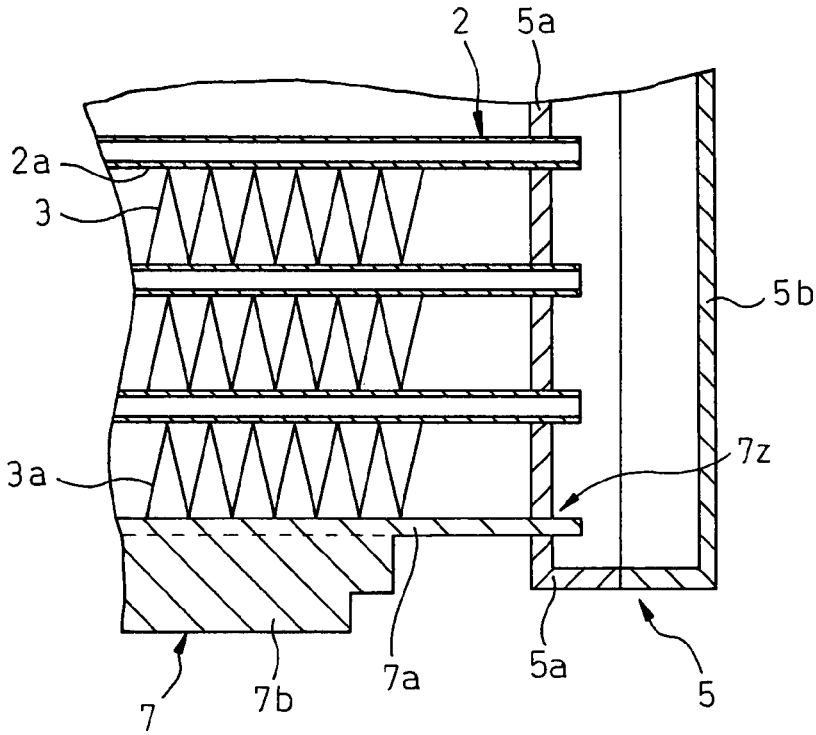
FIG. 2 is an enlarged cross-sectional view of a portion X of FIG. 1.
Figure 3:
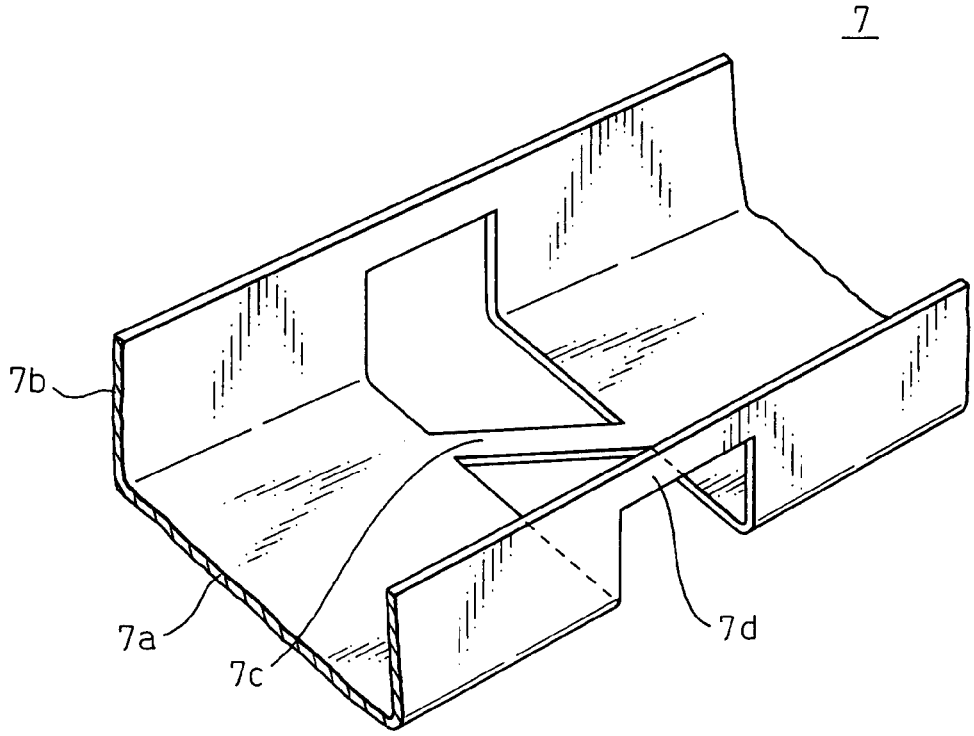
FIG. 3 is an enlarged view of a portion Y of FIG. 1, that is, a perspective view showing a side plate (no cuts in bridge portions) according to the present invention before brazing.
Figure 4:
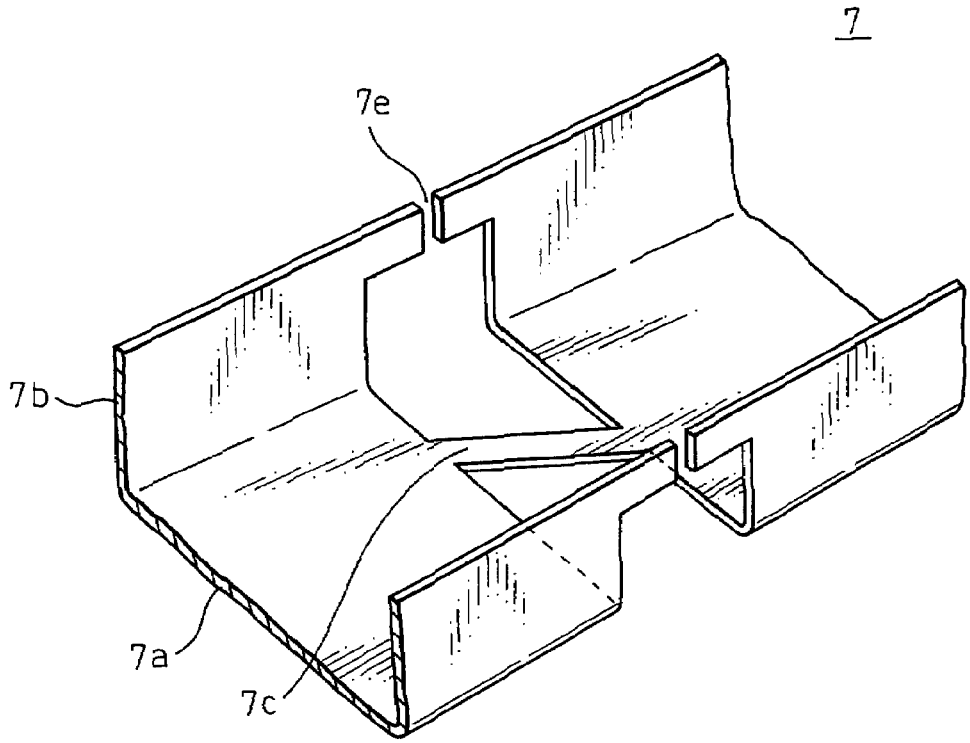
FIG. 4 is a side plate (cuts in bridge portions) according to the present invention after brazing.
Figure 5:
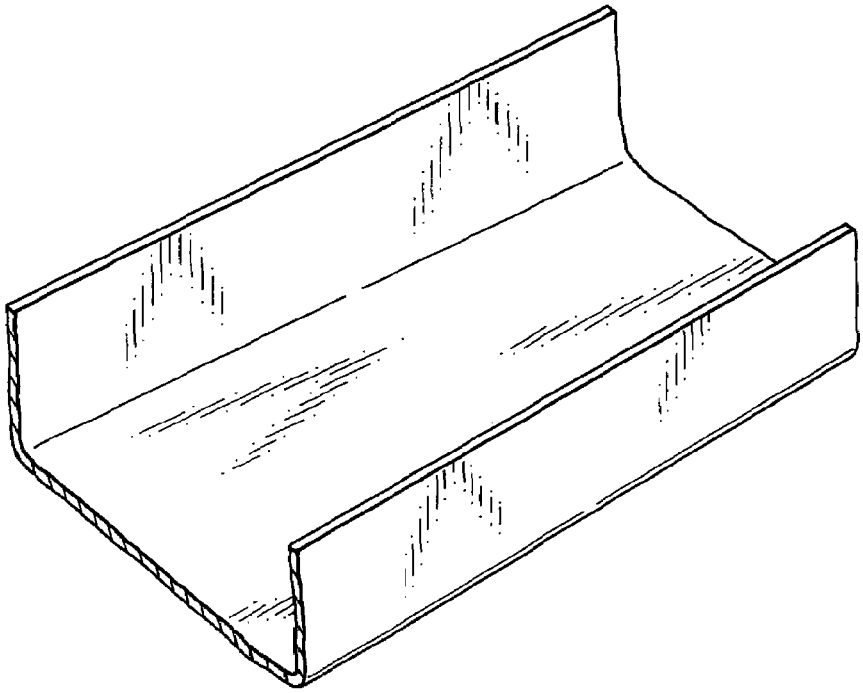
FIG. 5 is a view of a side plate of a conventional example.

Below, a first embodiment of the present invention will be explained based on FIGS. 1 to 4. The first embodiment is a heat exchanger (oil cooler) 100 according to the present invention exchanging heat between the vehicle transmission oil and the atmosphere (air). FIG. 1 is an overview of an oil cooler 100 according to the first embodiment, while FIG. 2 is an enlarged cross-sectional view of a portion X of FIG. 1. FIG. 3 is an enlarged view of a portion Y of FIG. 1 showing a side plate (no cuts in bridge portions) according to the present invention before brazing. FIG. 4 is a side plate (cuts in bridge portions) according to the present invention after brazing. Note that FIG. 5 shows a side plate of a conventional example.

As shown in FIG. 1, the heat exchanger of the present invention is an oil cooler 100 air-cooling the oil of a vehicular transmission (not shown). The heat exchanger 100 of the present invention differs from the heat exchanger of the conventional type only in the side plates 7. The rest of the parts are completely the same.

The oil cooler 100 is comprised of a plurality of tubes 2 through a transmission oil passes, a plurality of fins 3 alternately stacked with the tubes and increasing the heat transfer of said oil, core plates 5*a* to which the two ends of said tubes 2 are connected, and side plates 7 arranged at the outsides in the stacking direction from the end fins 3*a* arranged further outside from the tubes arranged at the outermost sides in the stacking direction of the tubes and connected to the core plates 5*a*. Further, as shown in FIG. 2, the two ends of the tubes 2 and the side plates 7 are respectively inserted in tube holes and side plate holes provided in the core plates 5*a* and those inserted parts are brazed.

In FIG. 1, the tubes 2 are tubes in which the oil flows. The tubes 2 are formed in flat shapes so that the direction of circulation of the air (direction vertical to paper surface) matches with the longitudinal directions. A plurality of tubes are alternately arranged in parallel the vertical direction (direction of stacking of the tubes) so that their axial directions match with the horizontal direction.

Corrugated fins 3 formed in wave shapes are brazed to the flat surfaces 2*a* of the tubes 2 (see FIG. 2). The fins 3 increase the heat transfer area with the air and promote heat exchange of the transmission oil and air. Note that below, the substantially block shaped heat exchange portion comprised of the tubes 2 and the fins 3 will be called the "core portion 4".

Header tanks 5 extend in directions perpendicular to the axial directions of the tubes 2 (vertical direction in the present embodiment) at the axial direction ends of the tubes 2 (the left and right ends in the present embodiment) and communicate with the plurality of tubes 2. The header tanks 5 are comprised of core plates 5*a* in which the tubes 2 are inserted and bonded and tank bodies 5*b* forming tank inside spaces with the core plates 5*a*.

Further, one tank 5 is provided with a pipe connection 5*d* to which an oil pipe (not shown) connecting an oil path provided in a transmission (not shown) and the oil cooler 100. The pipe connection 5*d* is an oil inlet into which oil flows from the transmission side. Further, a pipe connection 6*a*, part of the return pipe 6, is an oil outlet from which oil flows from the oil cooler 100 to the transmission side. However, the oil inlet and outlet may also be reversed.

As shown in FIG. 1, oil flowing in from the pipe connection 5*d* to the heat exchanger 100 first flows into the right side header tank 5*b*.Then, the oil flowing into the right side header tank 5*b* passes through within the tubes 2 and proceeds in the left direction while exchanging heat with the atmosphere and flows into the left side header tank 5*b*. The oil stored in the left side header tank 5*b* passes through the connection opening 6*b* with the return pipe 6 of the left side header tank 5*b* and flows into the return pipe 6. The oil passes through the return pipe 6 in the right direction and flows out from the pipe connection 6*a* to the transmission side.

On the other hand, the two ends of the core portion 4 (in the present embodiment, the top and bottom ends) are provided with side plates 7 extending substantially parallel with the axial direction of the tubes 2 and reinforcing the core portion 4. As shown in FIG. 3, the side plates 7 have base portions 7*a* having surfaces substantially parallel to the flat surfaces 2*a* of the tubes 2 (see FIG. 2) and extending substantially parallel to the axial directions of the tubes 2 and standing walls 7*b* sticking out in directions substantially perpendicular to the base portion 7*a* and extending substantially parallel to the axial directions of the tubes (in the present embodiment, the horizontal directions).

In the side plates 7, the standing walls 7*b* are provided at the two ends of the base portions 7*a* in the width directions of the base portions 7*a*, so the cross-sectional shapes of the side plates 7 are substantially U-shaped cross-sections opening at the sides opposite from the core portion 4. The reason for making the cross-sectional shapes of the side plates 7 substantially U-shaped cross-sections is to secure the rigidity of the side plates 7. Inside the cross-section of one side plate 7, a pipe 6 extends. The pipe 6 is curved and sticks out from inside the cross-section near the bridge portions 7*c*, 7*d*. Because of this, space is secured near the bridge portion 7*d*, so the work of cutting the bridge portion 7*d* becomes easy after finishing the brazing. Further, the side plates 7 contact the core portion 4 by being brazed with the fins 3*a*, so heat is transferred with the core portion 4.

As shown in FIGS. 1 and 3, each side plate 7 is provided with bridge portions 7*c* and 7*d* at its approximate central portion in the longitudinal direction. Note that these bridge portions may be provided at any positions in the intermediate portion in the longitudinal direction of the side plate 7. The bridge portion 7*c* extends at an angle with respect to the longitudinal direction of the side plate 7. FIG. 3 shows the state before brazing and at the time of brazing of the tubes 2 and fins 3 with the side plate 7. When the brazing is completed, the bridge portions 7*d* at the two sides are cut to form slits 7*e* as shown in FIG. 4. Note that by providing the bridge portions 7*d* at the peripheral sides (after assembly) of the side plate 7, the cutting of the bridge portions 7*d* becomes easy.

Figure 6A:
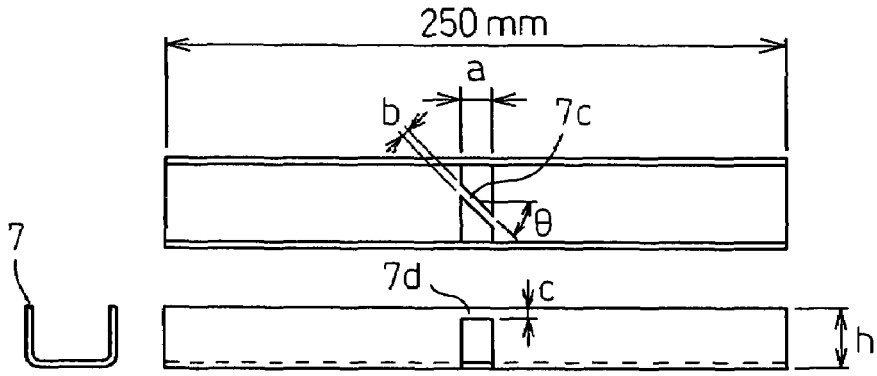
Figure 6B:
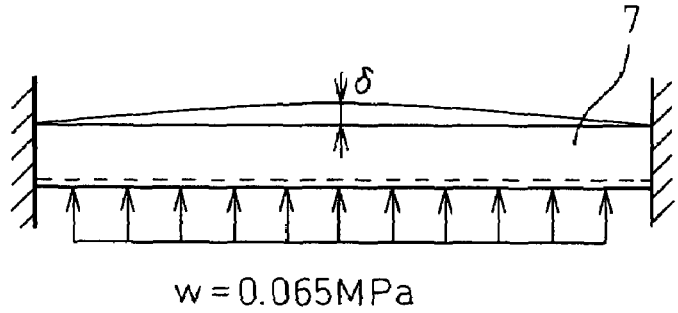
Figure 6C:
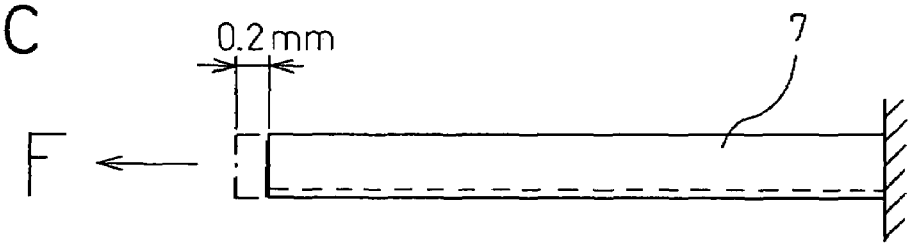

The reason the bridge portions 7*c* and 7*d* and the slits 7*e* are provided will be explained based on FIGS. 6A to 6C and FIG. 7. FIGS. 6A to 6C and FIG. 7 are views for explaining calculations for simulation of beam deformation when providing the bridge portions 7*c* and 7*d* and the bridge portion slits 7*e* in a side plate 7. Specifically, FIGS. 6A to 6C are views showing the calculation conditions by schematic views, wherein FIG. 6A is a three-sided view of a side plate 7 being calculated, FIG. 6B is a view showing the calculation conditions for calculating deflection, and FIG. 6C is a view showing the force when forcibly displacing a side plate 7. FIG. 7 is a view of the results of different types of simulation calculations under the calculation conditions of FIG. 6.

The side plate being calculated were made three types. The first type is the first embodiment of the present invention (with slanted bridge portions), the second type is a modification of the first embodiment (with straight bridge portions), and the third type is a conventional type with no bridge portions. These types of side plates were first, as shown in FIG. 6B, subjected to equally distributed loads of 0.065 MPa to find the deflection δ. At this time, each side plate was fixed at the two ends. The equally distributed load of 0.065 MPa was the pressure envisioned to be applied by the wires when brazing the tubes and the fins with the side plate. A small deflection δ means smaller variation in fin deformation during brazing due to the difference of fin positions, so stable brazing becomes possible.

Next, as shown in FIG. 6C, the force required for making the side plate displace by 0.2 mm in the longitudinal direction (below referred to as the "forced displacement force"). At this time, the side plate was fixed at one side. This was the force envisioned to be applied when the side plate thermally expanded. A small force means a small thermal stress, so is preferable. This calculation was performed for cases of cutting and no cutting of the bridge portions 7*d*.

The inventors ran simulation calculations under the above conditions. The results are shown in FIG. 7. The fact that type 1 of the first embodiment according to the present invention is the most suitable when considering the stability during brazing and the thermal stress during thermal expansion is clear from the results of the calculation of FIG. 7. That is, if comparing type 1 and the conventional example of type 3, type 1 has a deflection δ only 26% larger than type 3, while only requires 21% of the forced displacement force (at the cutting of the bridge portions) compared with type 3. Further, comparing type 1 and type 2, type 1 has a deflection δ only 9% weaker than type 3, while only requires 60% weaker forced displacement force (at the cutting of the bridge portions) compared with type 2.

That is, the side plate of type 1, compared with type 2 and 3, did not increase in deflection that much, but was greatly reduced in forced displacement force (at the cutting of the bridge portions). This means that the stability at the time of brazing is not inhibited that much compared with the past types and the thermal stress can be greatly reduced.

Second Embodiment

Next, a second embodiment of the present invention will be explained based on FIG. 8. Note that parts having substantially the same functions as the first embodiment are assigned the same reference numerals and their explanations are omitted. The second embodiment is that of a heat exchanger 200 having separate paths through which a plurality of heat exchange media pass. The plurality of heat exchange media are, for example, vehicle transmission oil (below simply referred to as "oil") and air-conditioning refrigerant. The heat exchanger inlet temperature of the oil is approximately 140° C., and the heat exchanger inlet temperature of the refrigerant is approximately 70° C.

Figure 8:
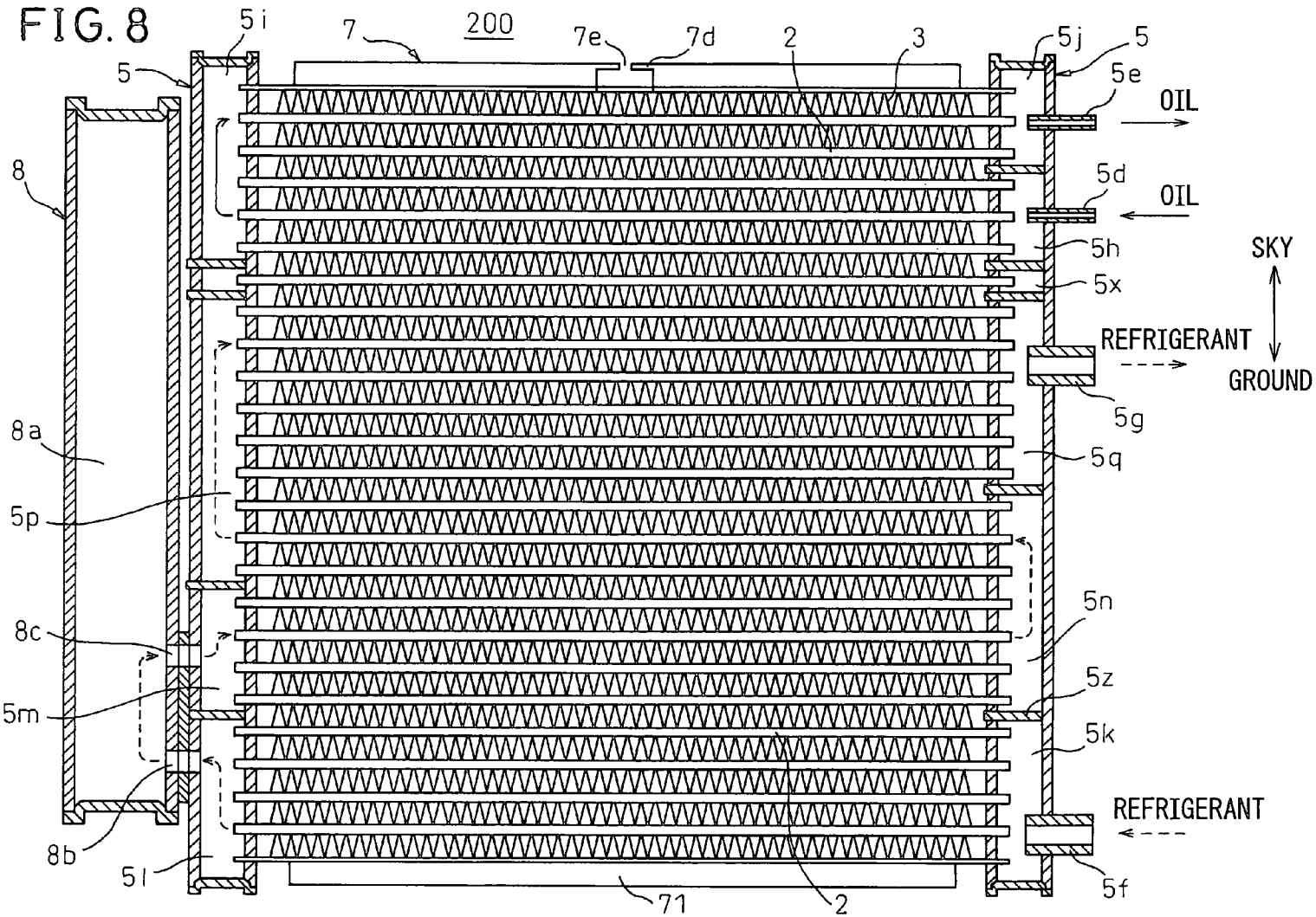
FIG. 8 is an overview of a heat exchanger according to a second embodiment of the present invention.

FIG. 8 is an overview of the heat exchanger 200 according to the second embodiment of the present invention. Reference numeral 8 is a modulator which stores the air-conditioning refrigerant, while 71 is a conventional type of side plate with no bridge portions at all. Reference numeral 5*d* is an oil inlet and 5*e* is an oil outlet. Reference numeral 5*f* is a refrigerant inlet and 5*g* is a refrigerant outlet. Note that the inlets and outlets of the oil and refrigerant can reversed. Reference numeral 5*x* is a subchamber in which there is no heat exchange medium and only air. This is for detecting the leakage of oil and refrigerant for preventing the trouble of the oil and refrigerant mixing. 5*z* is a divider (separator) which divides the inside of the header tank 5 into a plurality of small chambers.

The side plate 7 is arranged near the tubes 2 through which the high temperature heat exchange medium, that is, the oil, passes and is easily affected by thermal expansion, so has bridge portions 7*c* and 7*d*, but the side plate 71 is arranged near the tubes 2 through which the low temperature heat exchange medium, that is, the refrigerant, passes and is resistant to the effect of thermal expansion, so does not need to have the bridge portions.

First, the circulation path of the high temperature heat exchange medium oil will be explained. Oil flowing in from the transmission (not shown) via the oil inlet 5*d* to the heat exchanger 200 passes from the header tank subchamber 5*h* to the tubes 2 in the left direction, reaches the header tank subchamber 5*i*, then passes through the upper tubes conversely to the right direction, reaches the header tank subchamber 5*j*,then flows out via the oil outlet 5*e* to the transmission (not shown).

Next, the circulation path of the low temperature heat exchange medium refrigerant will be explained. The refrigerant compressed by a refrigerant pump (not shown) flows in from the refrigerant inlet 5*f* to the heat exchanger 200, passes from the header tank subchamber 5*k* to the tubes 2 in the left direction, reaches the header tank subchamber 51, and flows via the modulator inlet 8*b* to the modulator 8. The refrigerant flowing into the modulator 8 flows in from the modulator outlet 8*c* to the header tank subchamber 5*m*, then passes through the upper tubes 2 conversely in the right direction, reaches the header tank subchamber 5*n*, then passes through in the upper tubes 2 to the left direction and reaches the header tank subchamber 5*p*. The refrigerant flowing into the header tank subchamber 5*p* passes through the upper tubes 2 conversely in the right direction, reaches the header tank sub-chamber 5*q*, and flows out from the refrigerant outlet 5*g* to an expansion valve (not shown).

The second embodiment is a single heat exchanger, so it is possible to make heat exchangers for a plurality of heat exchange media more compact. Further, it is not necessary to provide bridge portions at the side plate resistant to the effect of thermal expansion, so by employing the side plate 71 of the conventional type with no bridge portions at all, it becomes possible to eliminate unnecessary processes.

Third Embodiment

As the plurality of heat exchange media, oil and engine coolant water can be used. The heat exchanger inlet temperature of the engine coolant water is a high temperature of approximately 100° C. Because of this, in FIG. 8, it is desirable to make the side plate 71 (no bridge portions) of the lower side identical to the side plate 7 (with bridge portions) of the upper side. That is, both side plates have bridge portions.

Other Embodiments

As the heat exchanger according to the present invention, it is cover radiators for cooling inverters and other electronic components controlling electric motors in hybrid vehicles and the like.

As explained above, according to the embodiments of the present invention, it becomes possible to provide a heat exchanger enabling prevention of breakage of joints of the tubes and the side plates at the core plates, easy to produce, and reduced in cost which has side plates enabling stable brazing of the tubes and the fins with the side plates.

While the invention has been described with reference to specific embodiments chosen for purpose of illustration, it should be apparent that numerous modifications could be made thereto by those skilled in the art without departing from the basic concept and scope of the invention.

The invention claimed is:

1. A heat exchanger provided with:

a plurality of tubes through which a heat exchange medium passes, a plurality of fins alternately stacked with the tubes and increasing the heat transfer of said heat exchange medium, core plates to which two ends of said tubes are connected, tank bodies connected to the core plates forming tank inside spaces with the core plates, and side plates arranged at outsides in the stacking direction from the end fins arranged at outermost sides in the stacking direction of the fins and connected to the core plates, wherein header tanks are comprised of the core plates and tank bodies, and the header tanks have pipe connections one of which is a heat exchange medium inlet and the other is a heat exchange medium outlet, and one of the pipe connections has a pipe, at least one of said side plates has a plurality of bridge portions at intermediate locations in the longitudinal direction, at least one of said bridge portions has a slit provided by cutting after the brazing of said tubes and said fins; and said at least one of said side plates has a substantially U-shaped cross-section, the pipe is arranged extending inside said substantially U-shaped cross-section, and the pipe sticks out from the insides of the substantially U-shaped cross-section near said bridge portion.

2. A heat exchanger according to claim 1, wherein said slit is provided at the periphery of said at least one side plate assembled in said heat exchanger.

3. A heat exchanger according to claim 1, wherein at least one of said bridge portions which is not cut is bridged at an angle with respect to a longitudinal direction of said side plate.

* * * * *